US011656054B2

(12) United States Patent
Allgaier et al.

(10) Patent No.: US 11,656,054 B2
(45) Date of Patent: May 23, 2023

(54) TRAINING MAGAZINE

(71) Applicant: Mantis Tech, LLC, Oswego, IL (US)

(72) Inventors: Ammon Allgaier, Oswego, IL (US); Austin Allgaier, Oswego, IL (US); Louis Van Blarigan, Missoula, MT (US)

(73) Assignee: MANTIS TECH, LLC, Oswego, IL (US)

( * ) Notice: Subject to any disclaimer, the term of this patent is extended or adjusted under 35 U.S.C. 154(b) by 0 days.

(21) Appl. No.: 17/737,420

(22) Filed: May 5, 2022

(65) Prior Publication Data

US 2022/0364808 A1 Nov. 17, 2022

Related U.S. Application Data

(60) Provisional application No. 63/188,798, filed on May 14, 2021.

(51) Int. Cl.
*F41A 33/06* (2006.01)
*F41A 9/64* (2006.01)

(52) U.S. Cl.
CPC ..... *F41A 33/06* (2013.01); *F41A 9/64* (2013.01)

(58) Field of Classification Search
CPC ..... F41A 33/00; F41A 33/06
See application file for complete search history.

(56) References Cited

U.S. PATENT DOCUMENTS

| | | | | |
|---|---|---|---|---|
| 9,728,095 | B1 * | 8/2017 | Baxter | F41A 33/00 |
| 2011/0306020 | A1 * | 12/2011 | Peterson | F41A 33/06 434/18 |
| 2013/0108991 | A1 * | 5/2013 | Walls | F41A 17/36 434/24 |
| 2017/0146310 | A1 * | 5/2017 | Biran | F41A 17/066 |
| 2020/0064922 | A1 * | 2/2020 | Nocon | G06F 3/016 |
| 2020/0378724 | A1 * | 12/2020 | Seigler | F41G 3/2616 |

* cited by examiner

*Primary Examiner* — Derrick R Morgan
(74) *Attorney, Agent, or Firm* — Bennet K. Langlotz; Langlotz Patent & Trademark Works, LLC

(57) ABSTRACT

A training magazine has a body configured to be removably received in the magazine well, a motor connected to the body and operable to generate a motive force, an energy storage element operably connected to the motor and configured to store potential energy generated by the motive force, and an actuator operably engaged to the energy storage element and to the reciprocating action element, and operable to transmit the potential energy to reciprocate the action element. The reciprocating element may be a pistol slide. The energy storage element may be a spring. The spring may be a torsion coil spring having a cylindrical shape with opposed circular ends. There may be an input rotor operably connected to the motor and to a first end of the spring. There may be an output rotor connected to an output end of the spring and to the actuator.

19 Claims, 10 Drawing Sheets

TRAINING MAGAZINE

CROSS-REFERENCE TO RELATED APPLICATION

This application claims the benefit of U.S. Provisional Patent Application No. 63/188,798 filed on May 14, 2021, entitled "FIREARM TRAINING APPARATUS AND METHODS OF USING," which is hereby incorporated by reference in its entirety for all that is taught and disclosed therein.

FIELD OF THE INVENTION

The present invention relates to firearms, and more particularly to a training magazine that enables repeated dry firing of a firearm without having to retract the slide or other trigger resetting system or device of the firearm.

BACKGROUND AND SUMMARY OF THE INVENTION

When dry firing a fully functioning firearm, typically performed during a training exercise, traditionally the firearm's trigger mechanism remains in the fired position without resetting after each time the trigger is pulled. Thus, a shooter practicing dry firing must pull back the slide, hammer, charging handle, or other trigger resetting system and/or device of the firearm after each shot because a round was not fired to reset the mechanism. This results in an unnatural training experience for many types of semi-automatic and fully automatic firearms because nonstandard manipulations of the firearm are required between shots.

Therefore, a need exists for a new and improved training magazine that enables repeated dry firing of a firearm without having to retract the slide or other trigger resetting system or device of the firearm. In this regard, the various embodiments of the present invention substantially fulfill at least some of these needs. In this respect, the training magazine according to the present invention substantially departs from the conventional concepts and designs of the prior art, and in doing so provides an apparatus primarily developed for the purpose of enabling repeated dry firing of a firearm without having to retract the slide or other trigger resetting system or device of the firearm.

The present invention provides an improved training magazine, and overcomes the above-mentioned disadvantages and drawbacks of the prior art. As such, the general purpose of the present invention, which will be described subsequently in greater detail, is to provide an improved training magazine that has all the advantages of the prior art mentioned above.

To attain this, the preferred embodiment of the present invention essentially comprises a body configured to be removably received in the magazine well, a motor connected to the body and operable to generate a motive force, an energy storage element operably connected to the motor and configured to store potential energy generated by the motive force, and an actuator operably engaged to the energy storage element and to the reciprocating action element, and operable to transmit the potential energy to reciprocate the action element. The reciprocating element may be a pistol slide. The energy storage element may be a spring. The spring may be a torsion coil spring having a cylindrical shape with opposed circular ends. There may be an input rotor operably connected to the motor and to a first end of the spring. There may be an output rotor connected to an output end of the spring and to the actuator. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
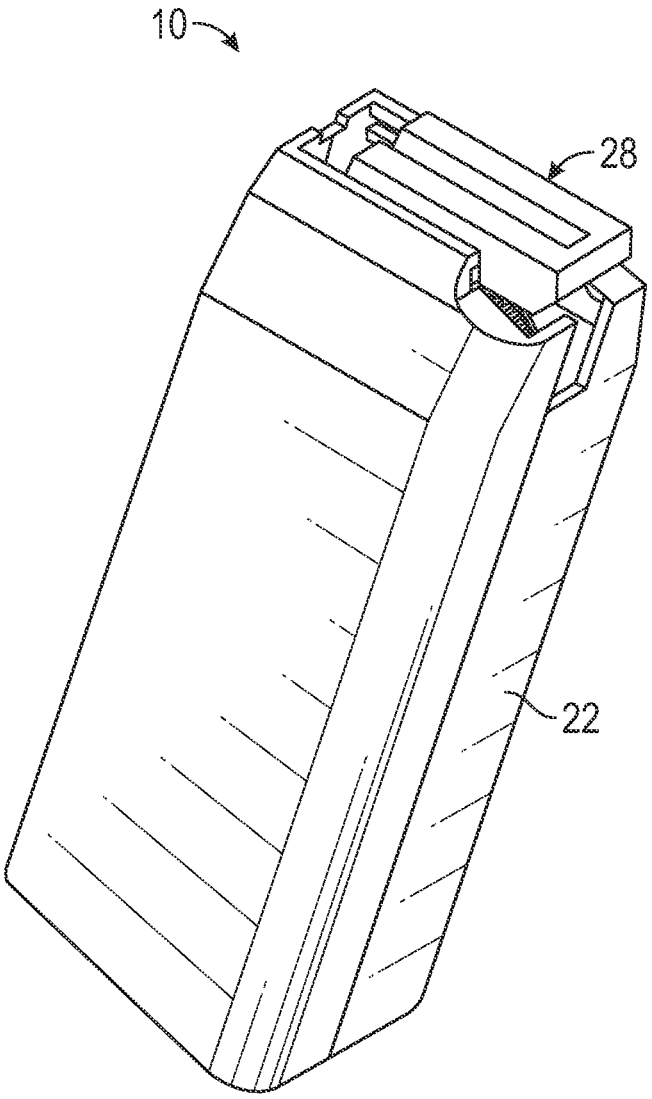
FIG. 1 is a top isometric view of the current embodiment of a training magazine constructed in accordance with the principles of the present invention.
Figure 2:
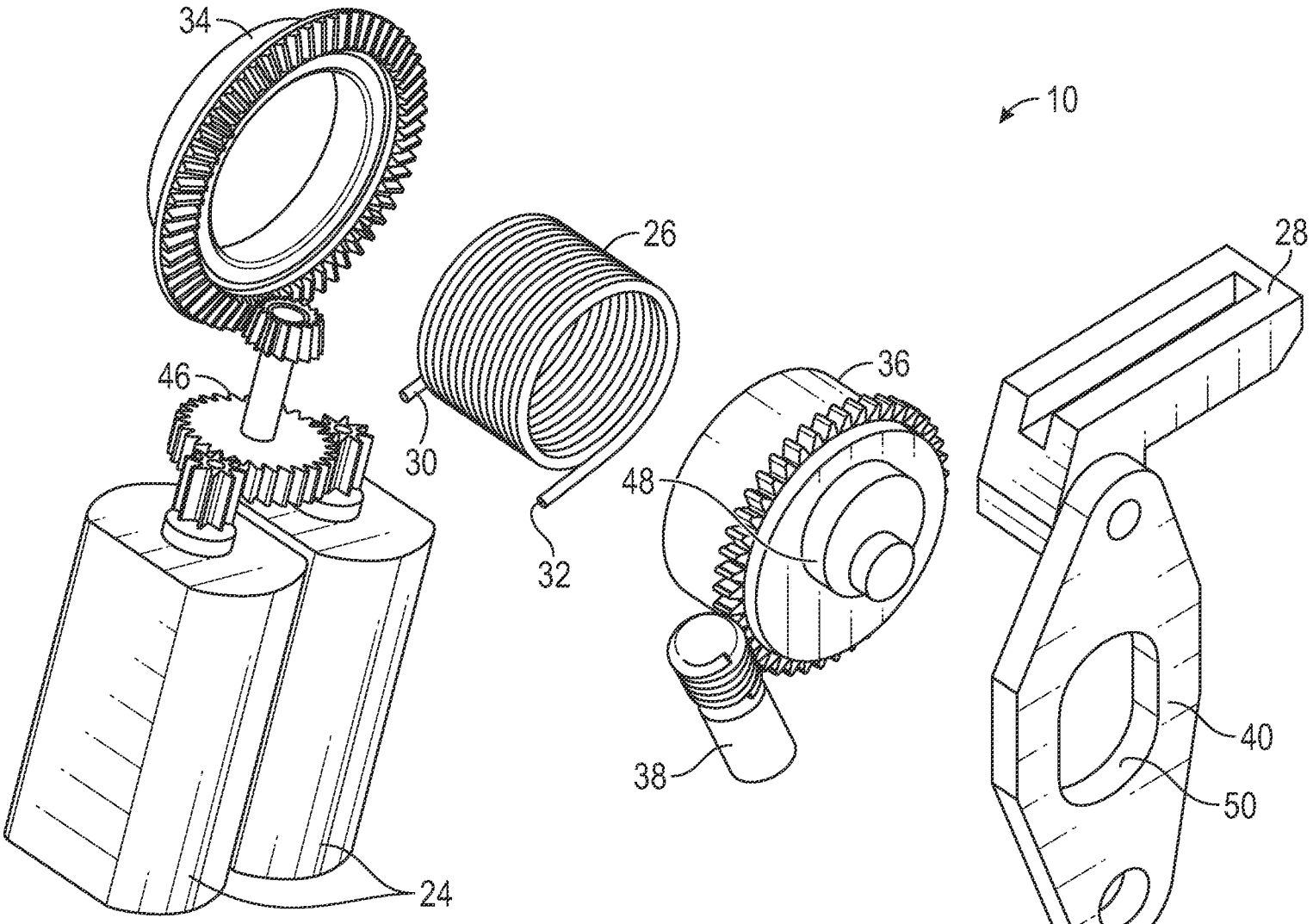
FIG. 2 is an exploded view of the training magazine of FIG. 1.
Figure 3:
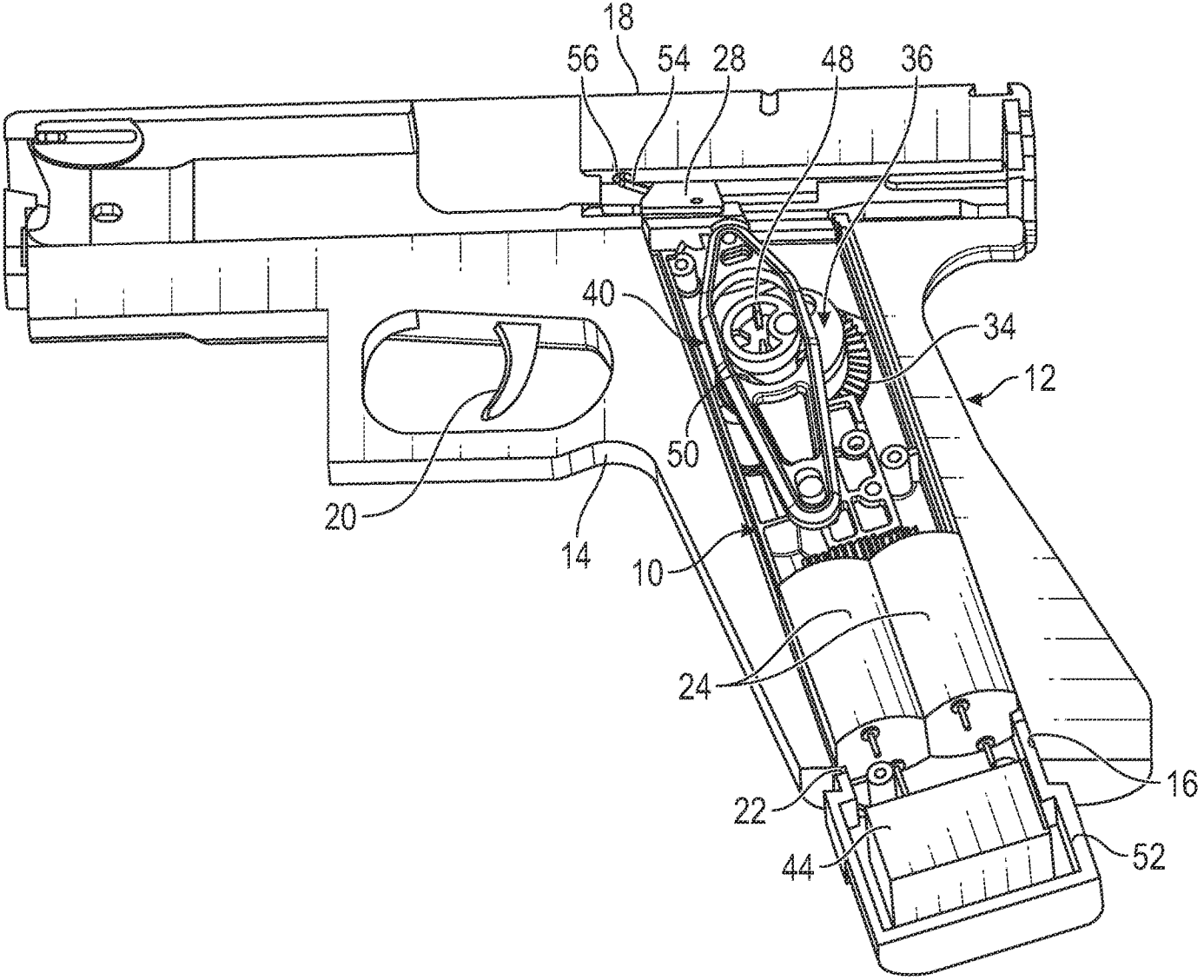
FIG. 3 is an isometric side sectional view of the training magazine of FIG. 1 in use installed in the magazine well of a pistol.
Figure 4:
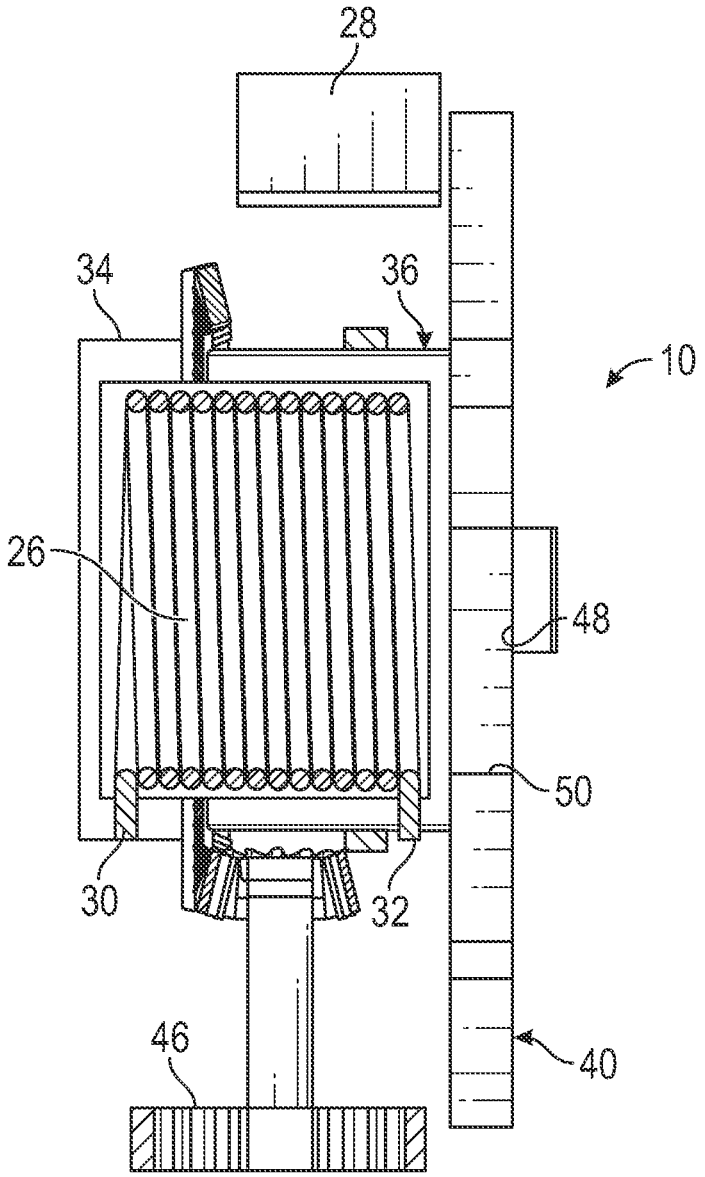
FIG. 4 is a front sectional enlarged view of the training magazine of FIG. 1.
Figure 5:
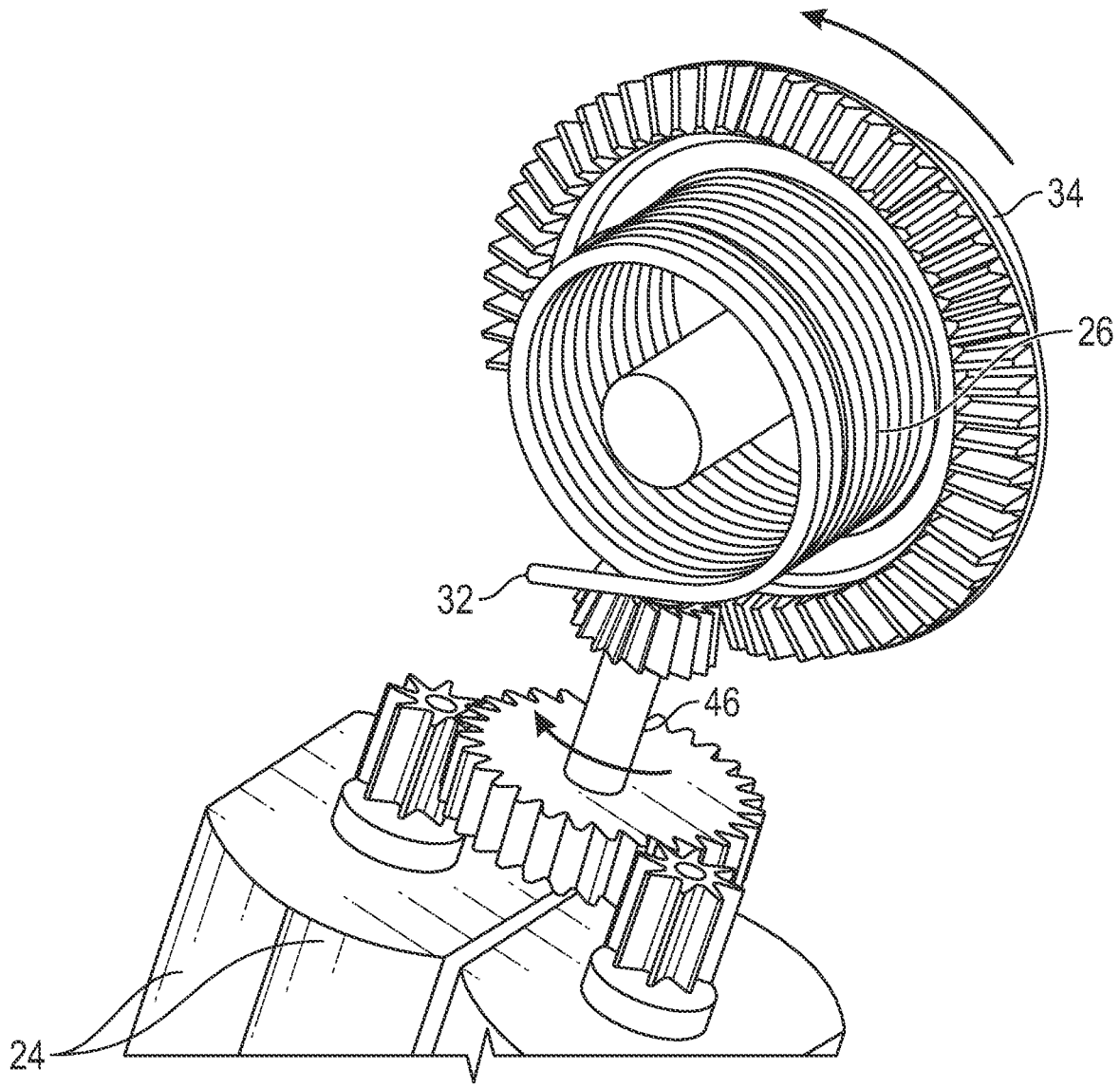
FIG. 5 is an enlarged isometric view of the motors, gear train, energy storage element, and input rotor of the training magazine of FIG. 1.

An embodiment of the training magazine of the present invention is shown and generally designated by the reference numeral 10.

FIGS. 1-5 illustrate the improved training magazine 10 of the present invention. More particularly, in FIG. 3, the training magazine is shown installed in a firearm 12 having a frame 14 defining a magazine well 16. The firearm includes a reciprocating action element 18 responsive to actuation of a trigger 20. The training magazine has a body 22 configured to be removably received in the magazine well. A motor 24 is connected to the body and is operable to generate a motive force. In the current embodiment, there are two motors. The motors can be solenoid motors, servomotors, a DC rotary motor, or an AC rotary motor. An energy storage element 26 is operably connected to the motor and is configured to store potential energy generated by the motive force. An actuator 28 is operably engaged to the energy storage element and to the reciprocating action element. The actuator is operable to transmit the potential energy to reciprocate the reciprocating action element via a hook 54 (shown in FIG. 3). The hook extends from the actuator engages a face 56 (shown in FIG. 3) on the reciprocating action element that would normally support the case head, and would also normally strip a cartridge from a conventional magazine.

Figure 7:
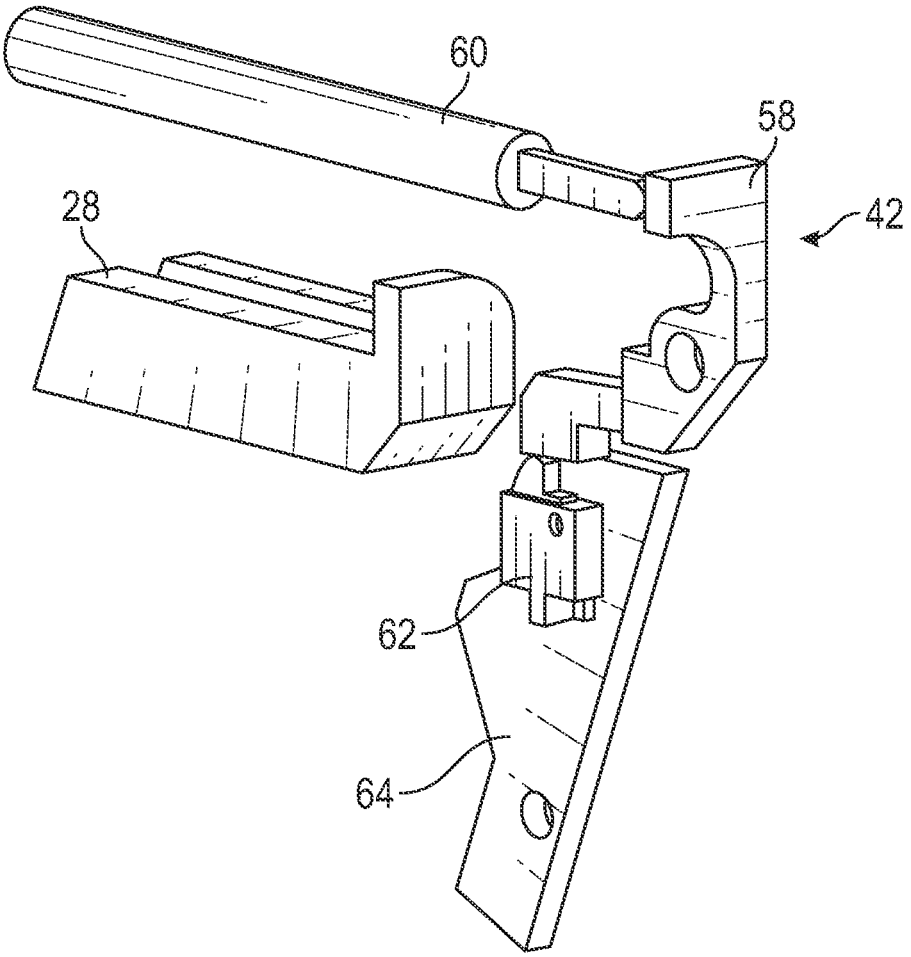
FIG. 7 is a rear isometric view of the control mechanism of the training magazine of FIG. 1.

In the current embodiment, the reciprocating action element 18 is a pistol slide, and the energy storage element 26 is a spring having a plurality of loops about a common axis that interconnects the motor 24 and the actuator 28. The spring is preferably a torsion coil spring having a cylindrical shape with opposed circular ends 30, 32. An input rotor 34 is operably connected to the motor and to a first end of the spring. The input rotor is connected to two motors by a gear train 46 in the current embodiment. An output rotor 36 is operably connected to an output end of the spring and to the actuator. The spring is received within the input and output rotors. The spring could also be a flat coil spring where the input rotor is connected to the inner end of the flat coil spring, and the output rotor is connected to the outer end of the flat coil spring, or vice versa. A control element 38 is connected to the output rotor and is operable to limit the rotation of the output rotor in terms of both the rotation rate and the total amount of rotation. In the current embodiment, the control element is a motorized worm gear, and the total amount of rotation is limited to one complete rotation. A pivoting lever 40 is connected to the output rotor and is configured to generate a reciprocating motion in response to rotation of the output rotor. This is accomplished by an eccentric cam 48 on the output rotor that is received within an elongated aperture 50 defined by the pivoting lever. A control mechanism 42 that is illustrated in FIG. 7 will be described subsequently is responsive to motion of the trigger 20 to enable motion of the actuator. A battery pack 44 contained in an extended baseplate portion 52 of the body 22 is connected to the motor to provide a power source. The battery pack can contain a lithium-ion battery or conventional replaceable batteries, and may be weighted so the training magazine 10 simulates the weight of a traditional loaded magazine.

The energy storage element 26 is operable to store energy from the motor 24 before releasing the energy to the actuator 28. The motor is operable to generate a selected amount of potential energy in the energy storage element over a first interval, and wherein the energy storage element is operable to generate motion of the actuator and reciprocate the reciprocating action element 18 over a shorter second interval. Thus, the motor is operable to flex the spring over a first interval, and the spring is operable to generate motion of the actuator and reciprocate the reciprocating action element over a shorter second interval. The input rotor 34 rotates only in a single direction as the reciprocating action element reciprocates. The output rotor 36 rotates only in a single direction as the reciprocating action element reciprocates. The energy storage element is free of any fixed connection to the body 22, such that all portions of the energy storage element move as the reciprocating action element reciprocates.

The training magazine 10 can allow for a finite number of shots before requiring the user to simulate reloading of the firearm 12. The training magazine can leave the firearm completely operational except that no ammunition is being fired when the trigger is pulled. The firearm's safety function can be unaffected by the training magazine.

Figure 6A:
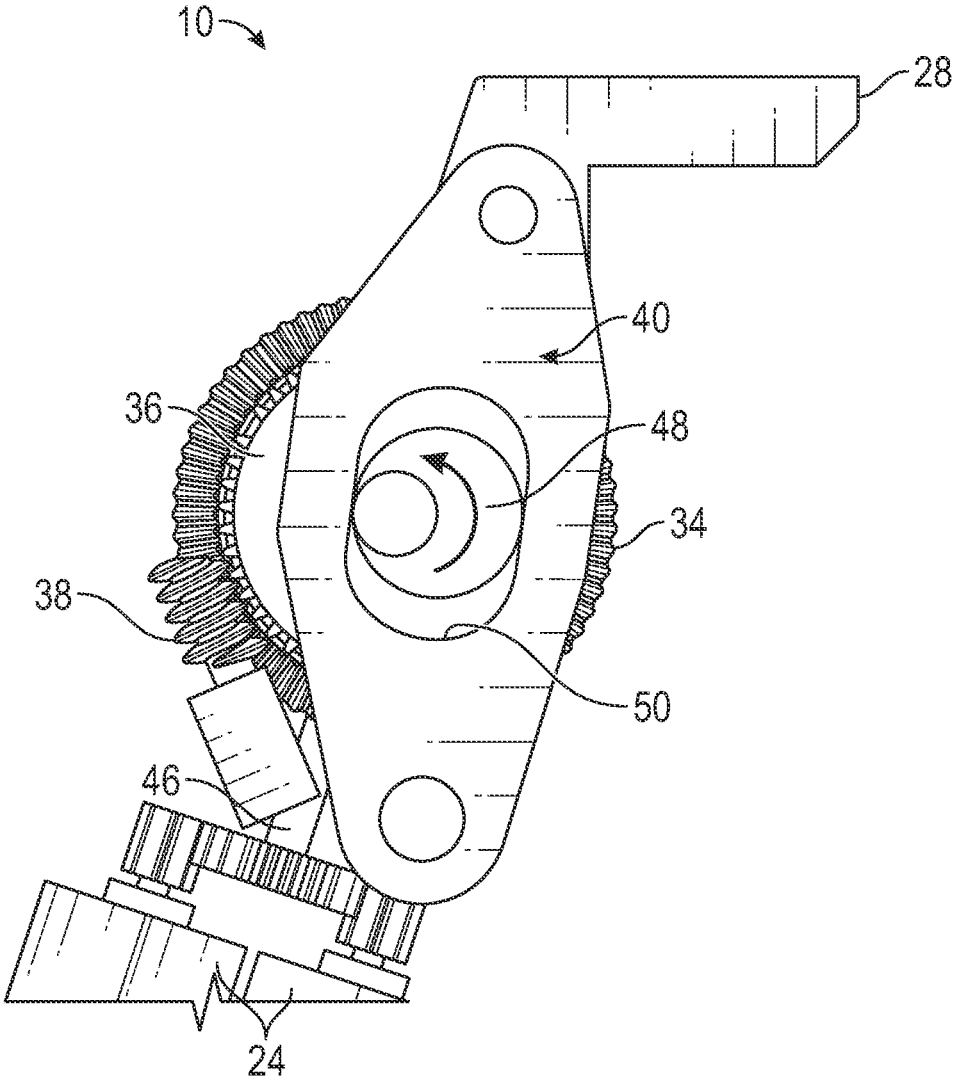
FIG. 6A is a side view of the training magazine of FIG. 1 with the actuator in the resting or start of travel position.
Figure 6B:
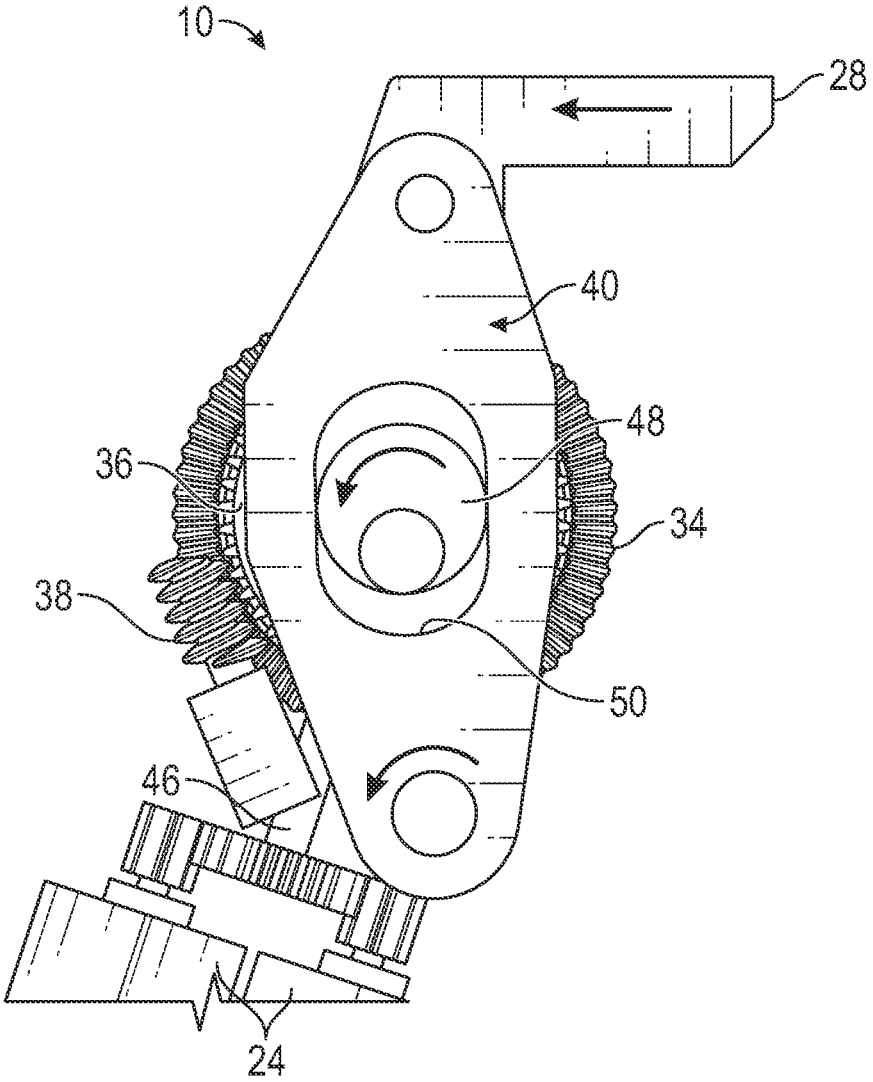
FIG. 6B is a side view of the training magazine of FIG. 1 with the actuator at the half travel position.
Figure 6C:
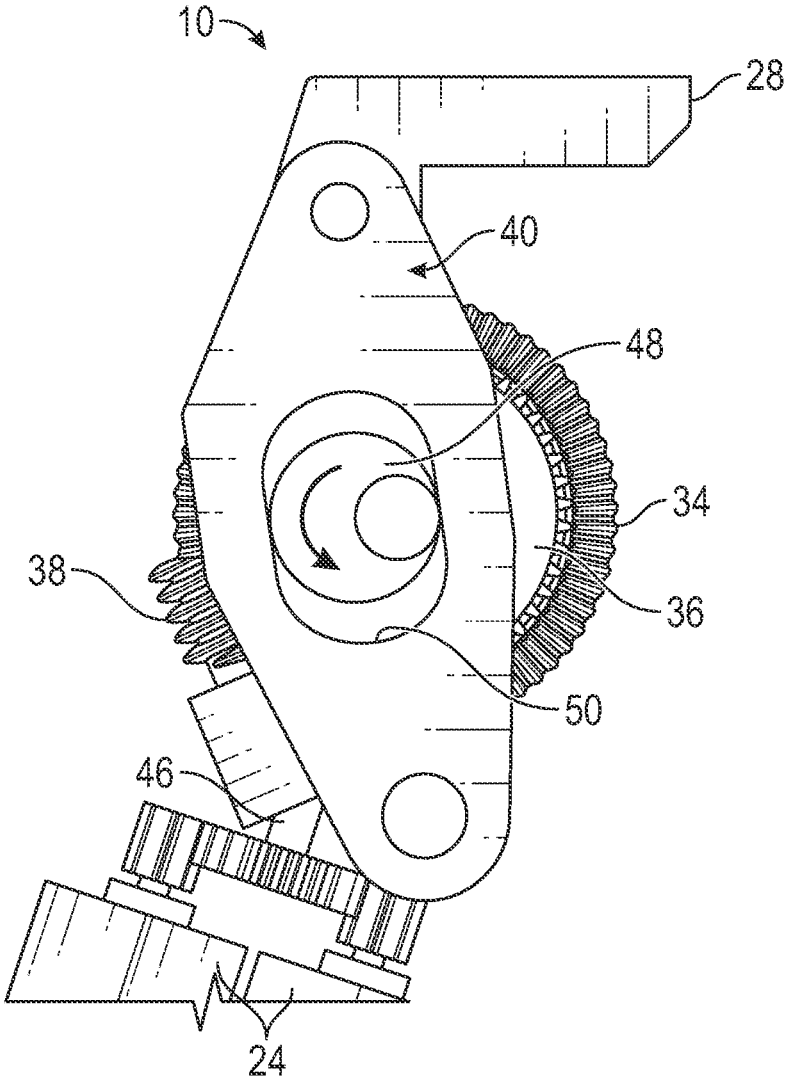
FIG. 6C is a side view of the training magazine of FIG. 1 with the actuator at the full travel position.
Figure 6D:
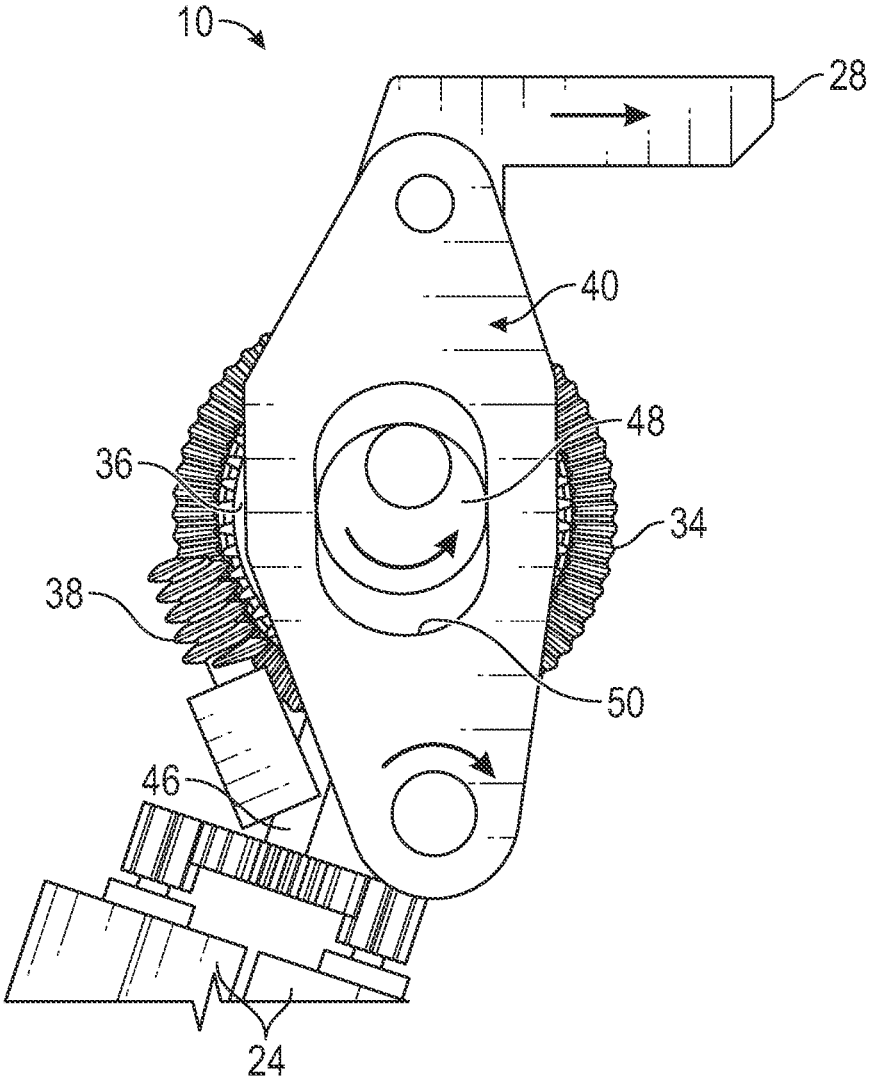
FIG. 6D is a side view of the training magazine of FIG. 1 with the actuator in the process of rapidly returning to the resting or start of travel position shown in FIG. 6A.

When the firearm 10 is fired with the training magazine installed, there is no discharge of a cartridge to provide energy to cycle the reciprocating action element to reset the firearm for another shot. Instead, as is shown in FIGS. 6A-D, the stored energy in the energy storage element 26 is released once the trigger 20 is pulled to enable the actuator 28 to pull the reciprocating action element rearward to reset the firearm for another shot. FIG. 6A shows the actuator in the resting or start of travel position. Once the trigger is pulled, the output rotor rotates and pivots the pivoting lever 40 rearward such that the actuator moves rearward and begins to pull the reciprocating action element rearward. FIG. 6B shows the actuator at the half travel position, and FIG. 6C shows the actuator at the full travel position. When the actuator has reached the full travel position, the reciprocating action element has been pulled rearward to the maximum extent. At the full travel position, the stored energy being released from the energy storage element is no longer sufficient to overcome the force exerted by the return spring of the firearm. Thus, the reciprocating action element rapidly pulls the actuator forward as shown in FIG. 6D to return the actuator to the resting of start of travel position shown in FIG. 6A and to reset the firearm for another shot. In the current embodiment, the training magazine can rest the firearm at a rate of 10 shots per second, which is sufficient to simulate the normal firing rate of semi-automatic firearms and some fully automatic firearms.

Optionally, the firearm's normal return spring can be replaced with a weaker spring to reduce the force and power requirements of the training magazine 10. The force reduction could be enough that the eccentric cam 48 would also force the pivoting lever 40 and actuator 28 forward, rather than simply allowing the return spring to return the reciprocating action element 18 to battery without assistance. The return spring could also be removed entirely, and the eccentric cam would provide all of the force to return the reciprocating action element to battery.

FIG. 7 illustrates the improved control mechanism 42 of the training magazine 10. More particularly, the control mechanism has a lever 58 that is connected to the actuator 28. When the firearm 10 is fired, the firing pin 60 impacts the lever. The lever actuates a detector switch 62 on a circuit board 64 in the training magazine, which then activates the training magazine to move the reciprocating action element 18. Alternatively, the lever could directly release the output rotor 36 when the lever is struck by the firing pin.

As a further alternative, a lever arm, switch, and circuit board can be contained by a housing that is shaped to mimic the shape of a normal barrel in the firearm, and which replaces the barrel in this embodiment. When the firing pin impacts the lever arm, the switch is activated on the circuit board. Activation of the switch turns on an optical transmitter (in this case, infrared), which may or may not be modulated. An optical receiver in the training magazine detects this optical signal and activates the training magazine to move the reciprocating action element.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a training magazine has been described in detail, it should be apparent that modifications and variations thereto are possible, all of which fall within the true spirit and scope of the invention. Although semi-automatic pistols have been disclosed, the training magazine is also suitable for use with fully automatic pistols, semi-automatic and fully automatic rifles, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A training magazine for a firearm having a frame defining a magazine well, and a reciprocating action element responsive to actuation of a trigger, the training magazine comprising:

a body configured to be removably received in the magazine well;

a motor connected to the body and operable to generate a motive force;

an energy storage element operably connected to the motor and configured to store potential energy generated by the motive force; and an actuator operably engaged to the energy storage element and to the reciprocating action element, and operable to transmit the potential energy to reciprocate the reciprocating action element.

2. The training magazine of claim 1 wherein the reciprocating action element is a pistol slide.

3. The training magazine of claim 1 wherein the energy storage element is a spring.

4. The training magazine of claim 3 wherein the spring is a torsion coil spring having a cylindrical shape with opposed circular ends.

5. The training magazine of claim 4 including an input rotor operably connected to the motor and to a first end of the spring.

6. The training magazine of claim 5 including an output rotor operably connected to an output end of the spring and to the actuator.

7. The training magazine of claim 6 including a control element connected to the output rotor and operable to limit the rotation of the output rotor.

8. The training magazine of claim 7 wherein the control element is a worm gear.

9. The training magazine of claim 5 including a pivoting lever connected to the output rotor and configured to generate a reciprocating motion in response to rotation of the output rotor.

10. The training magazine of claim 1 including a control mechanism responsive to motion of the trigger to enable motion of the actuator.

11. The training magazine of claim 1 wherein the motor is operable to generate a selected amount of potential energy in the energy storage element over a first interval, and wherein the energy storage element is operable to generate motion of the actuator and reciprocate the reciprocating action element over a shorter second interval.

12. The training magazine of claim 5 wherein the input rotor rotates only in a single direction as the reciprocating action element reciprocates.

13. The training magazine of claim 6 wherein the output rotor rotates only in a single direction as the reciprocating action element reciprocates.

14. The training magazine of claim 1 wherein the energy storage element is free of any fixed connection to the body, such that all portions of the energy storage element move as the reciprocating action element reciprocates.

15. A training magazine for a firearm having a frame defining a magazine well, and a reciprocating action element responsive to actuation of a trigger, the training magazine comprising:

a body configured to be removably received in the magazine well;

a motor operable to generate a motive force; an actuator operably engaged to the reciprocating action element;

a spring interconnecting the motor and the actuator; and wherein the spring is operable to store energy from the motor before releasing the energy to the actuator.

16. The training magazine of claim 15 wherein the motor is operable to flex the spring over a first interval, and wherein the spring is operable to generate motion of the actuator and reciprocate the reciprocating action element over a shorter second interval.

17. The training magazine of claim 15 wherein the spring is a torsion coil spring having a plurality of loops about a common axis.

18. The training magazine of claim 15 wherein the spring is free of any fixed connection to the body, such that all portions of the spring move as the reciprocating action element reciprocates.

19. The training magazine of claim 15 including a control mechanism responsive to motion of the trigger to enable motion of the actuator.

* * * * *